United States Patent [19]

Lichliter et al.

[11] 4,247,964

[45] Feb. 3, 1981

[54] CHIMNEY SWEEPING BRUSH

[76] Inventors: William L. Lichliter, Rte. 5 Box 781; Dennis N. Compton, 609 Bruce St., both of Winchester, Va. 22601

[21] Appl. No.: 78,707

[22] Filed: Sep. 25, 1979

Related U.S. Application Data

[62] Division of Ser. No. 950,552, Oct. 12, 1978, Pat. No. 4,200,339.

[51] Int. Cl.[3] ..... A46D 3/00; A46B 9/10; B08B 9/02

[52] U.S. Cl. ..... 15/162; 15/104.18; 15/200

[58] Field of Search ..... 15/104.18, 159 A, 162, 15/163, 164, 165, 169, 197, 200, 198, 180, 242, 243; 300/21

[56] References Cited

U.S. PATENT DOCUMENTS

| | | | |
|---|---|---|---|
| 289,132 | 11/1883 | Petmecky | 15/104.18 |
| 753,189 | 2/1904 | Buckelew et al. | 15/104.18 |
| 3,082,458 | 3/1963 | Nielsen | 15/180 |
| 3,105,261 | 10/1963 | Tilgner | 15/180 |

FOREIGN PATENT DOCUMENTS

| | | | |
|---|---|---|---|
| 68631 | 4/1914 | Switzerland | 15/163 |

*Primary Examiner*—Edward L. Roberts

*Attorney, Agent, or Firm*—Roylance, Abrams, Berdo & Farley

[57] ABSTRACT

There is disclosed a chimney cleaning brush which comprises a large number of bristles extending outwardly and upwardly from a center hub. The bristles are distributed symmetrically around the periphery of the hub. Each bristle comprises a pre-formed length of wire which is in the shape of a gentle arc.

3 Claims, 5 Drawing Figures

CHIMNEY SWEEPING BRUSH

This is a division of application Ser. No. 950,552, filed Oct. 12, 1978, now U.S. Pat. No. 4,200,339.

This invention relates to an improved wire brush for removing soot and other deposits from the inside walls of a chimney. The invention also relates to a novel method of manufacturing the wire brush.

A brush made in accordance with this invention, when viewed in the operational position inside a chimney, comprises a large number of bristles extending outwardly and upwardly from a center hub. The center hub is attached to a tension member which, in the preferred embodiment, is a common garden hose coupled to the hub of the brush. The brush is lowered down through the chimney at the end of the garden hose with the upward curvature of the bristles making it easy to lower the brush through the chimney opening. When the brush has reached the bottom most point of its travel, it is hauled up by means of the garden hose with the curvature and spring-like action of the wire bristles causing the bristles, which tend to conform to the size and shape of the chimney, to scrape loose the soot and deposits from the side walls of the chimney.

Briefly stated, the brush is constructed from conventional materials including bristles made from piano or other spring wire and a center hub assembled from two pipe flanges and a pipe nipple threaded at each end. The chimney sweeping wire brush is assembled by threading one pipe flange onto the first end of the pipe nipple so that the flat or planar surface of the pipe flange is flush with the first end of the pipe nipple. A vise or other supporting means is used to support, during assembly, the pipe nipple in the vertical position with the planar surface of the pipe flange held in the horizontal plane and facing upwardly. Thus, the second end of the pipe nipple faces downwardly and is secured in the vise. Bristles of suitable length are then cut from a loosely coiled supply of piano or other spring wire. The wire will retain at least part of the curvature of the roll after it is cut so that each section of wire forming a bristle is preformed into a gentle arc. A group of wires are formed into a bundle with one end of the bundle compressed into a tight bunch and with the other end of the wires flared out into an open spray. The end of the bundle, which is tightly compressed, is then inserted manually in a downwardly direction into the upper end of the pipe flange and nipple until the lower ends of the wires are flush with the lower or second end of the pipe nipple. A second pipe flange, manually held with its planar surface horizontal and facing downwardly towards the first pipe flange is inserted into the center and flared out upper end of the bundle of wire bristles.

The second upper flange is forced downwardly into the center of the bundle forcing the wire bristles to bend outwardly at their point of entrance into the pipe nipple while retaining their outward and downward curvature. When the downward travel of the upper flange has approached within approximately $1\frac{1}{2}$ inches of the lower flange, bolts are inserted through the corresponding holes of the two pipe flanges and nuts and lock washers are threaded onto the outer ends of the bolts. If necessary, the flanges are rotated with respect to each other about the longitudinal axis of the nipple to bring the bolt holes into alignment with each other. The bolts and nuts are now tightened to bring the pipe flanges closer to each other, being careful not to excessively tighten the bolts and thus over stress the pipe flanges, e.g., leaving about $\frac{1}{4}$ inch of space between the flanges.

The vise supporting the assembled brush is now loosened and the brush assembly is removed and inverted so that the second end of the pipe nipple faces upwardly and with the wire bristles, which retain their preformed curvature, curving upwardly. A female coupling of a garden hose is now threaded onto the second upper end of the male threads of the pipe nipple and the chimney sweeping brush is complete.

In use, the wire brush supported at the end by the garden hose is lowered into the opening of the chimney with the pre-formed bristles curving upwardly thus permitting the brush to slide down the side walls of the chimney during the lowering operation. The spring characteristics of the bristles allow the brush to conform to the inside shape of the chimney.

Having reached the bottom of the chimney, the brush may now be withdrawn upwardly causing the ends of the bristles to contact and scrape clean the inner walls of the chimney. The lowering and raising action of the brush may be repeated as necessary. Uniform cleaning of all of the walls of the chimney will occur even though the side walls may be inclined, i.e., other than vertical. This is the result of the pre-formed curvature of the spring wire bristles.

It is an object of this invention to provide an apparatus which will effectively clean all of the interior surfaces of a chimney.

It is a further object of this invention to provide a chimney sweeping brush which will conform to a variety of shapes of the interior passageways of chimneys.

It is another object of this invention to provide a chimney sweeping brush which is easily made from available parts, inexpensive, and requires little skill to assemble.

It is a still further object of this invention to provide a chimney sweeping brush wherein the spring-like action of the bristles combined with the direction of the bristle wires in relation to the side walls of the chimney result in a thorough and efficient cleaning action.

In order to understand the manner in which the foregoing and other objects are attained according to this invention, a particularly advantageous embodiment of the invention is described with reference to the accompanying drawings, wherein.

Figure 1:
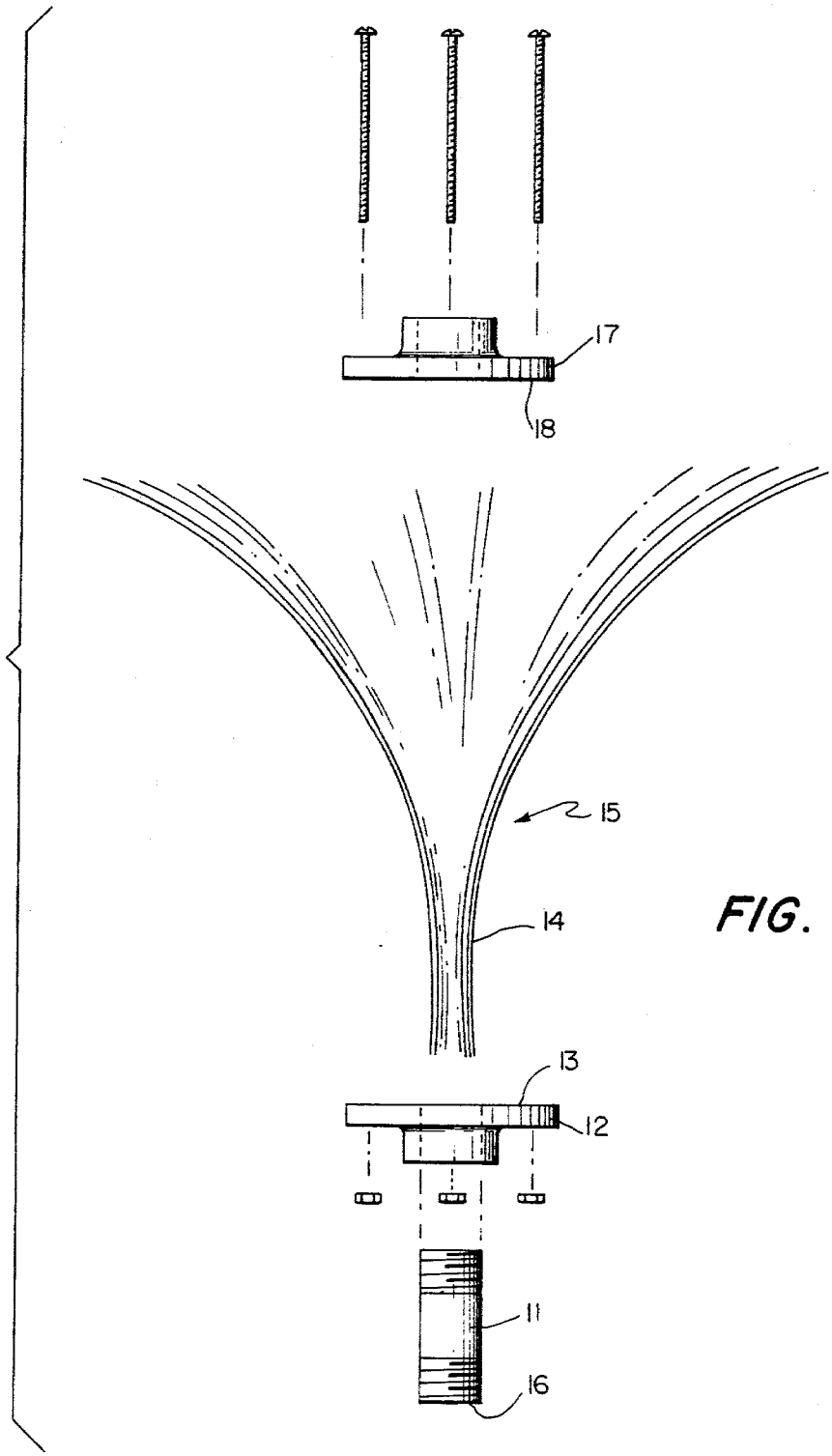
FIG. 1 is an exploded view of the component parts from which the chimney sweeping brush is manufactured, the components being shown in side elevation.

Component parts of the chimney sweeping brush are shown in FIG. 1 including a pipe nipple 11 threaded at both ends. In order that the nipple may mate with a standard threaded garden hose coupling as later described, the pipe nipple size is chosen as $\frac{3}{4}$ inch nominal diameter with 14 threads per inch and having an overall length of approximately 2 inches. The diameter of the pipe nipple therefore determines the diameter of the internal bore and the pitch of the threads of the pipe flange 12 to which it is threaded. After securing the pipe flange to the pipe nipple, the assembly is clamped in a vise or other convenient support not shown with the planar surface 13 of the flange facing upwardly. A quantity of bristles 14 are cut from a loosely formed roll of wire so that the bristles retain a pre-formed curvature. Many types of spring wire are readily available and satisfactory for the purpose intended. "Music wire", which is completely defined by ASTM specification—A 228, the disclosure of which is incorporated herein by reference, is recommended as the preferred type. A quantity of bristles 14 are formed into a bundle shown generally as 15 with the lower end of the bundle being tightly compressed and ready for insertion through flange 12 and into the bore of the nipple 11. The upper ends of the bristles 14 are flared into a generally symmetrical spray having substantially even distribution around the periphery of the flange 12. The wires 14 forming the bundle 15 are pushed downwardly into the bore until they are approximately flush with the lower end 16 of the nipple 11.

The second pipe flange 17 having its planar surface 18 facing downwardly and in axial alignment with the first pipe flange 12 is manually lowered into the center of the bundle 15 of bristles 14 displacing the bristles downwardly and outwardly.

Figure 2:
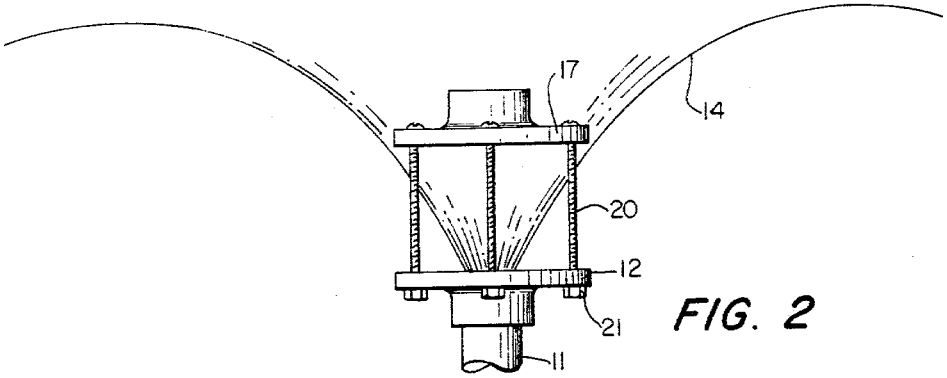
FIG. 2 is a view of a partially assembled chimney sweeping brush shown in side elevation.

With the second flange approximately 1½ inches from the first flange, bolts 20 are inserted into corresponding holes of the two flanges 12 and 17, as best seen in FIG. 2. Nuts 21 are threaded onto the bolts 20 and are gently tightened manually.

Figure 3:
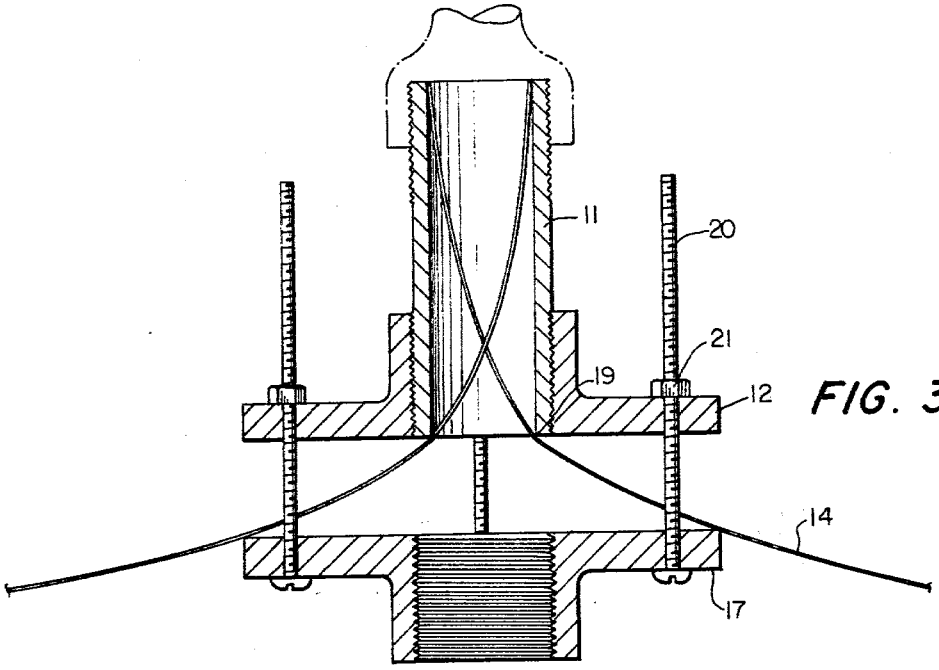
FIG. 3 is a longitudinal cross-sectional view of the chimney sweeping brush taken on lines 3—3 of FIG. 5.
Figure 4:
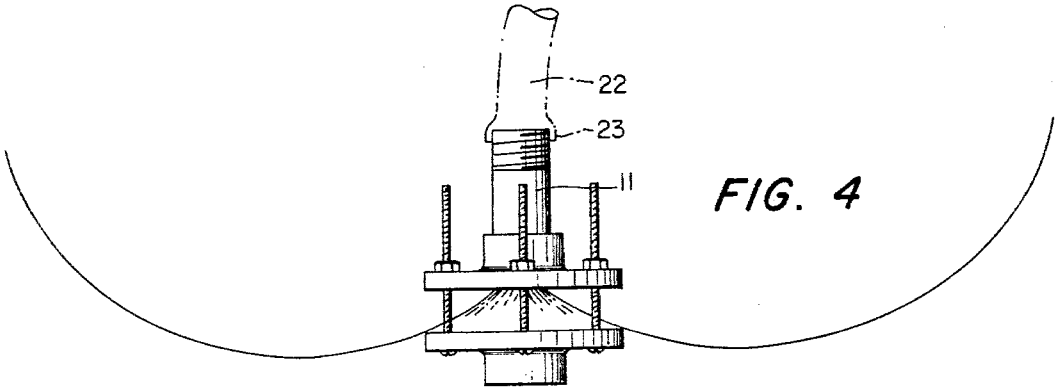
FIG. 4 is a side elevation of a completed chimney sweeping brush supported in an upright position on the end of a garden hose.

As the second flange 17 approaches the first flange 12, the pre-formed curvature of the bristles is deformed over the inner corner 19 of nipple 11 as best seen in FIG. 3. The deformation of the bristles over the inner corner of the nipple does not cause a change in the pre-formed curvature of the outer portion of the bristles but only causes the bristles to bend over the corner 19 to reach a new downward location. Care should be taken to avoid excessive tightening of the nuts to prevent further deformation of the pre-formed wire and also to prevent possible fracture of the pipe flanges.

Figure 5:
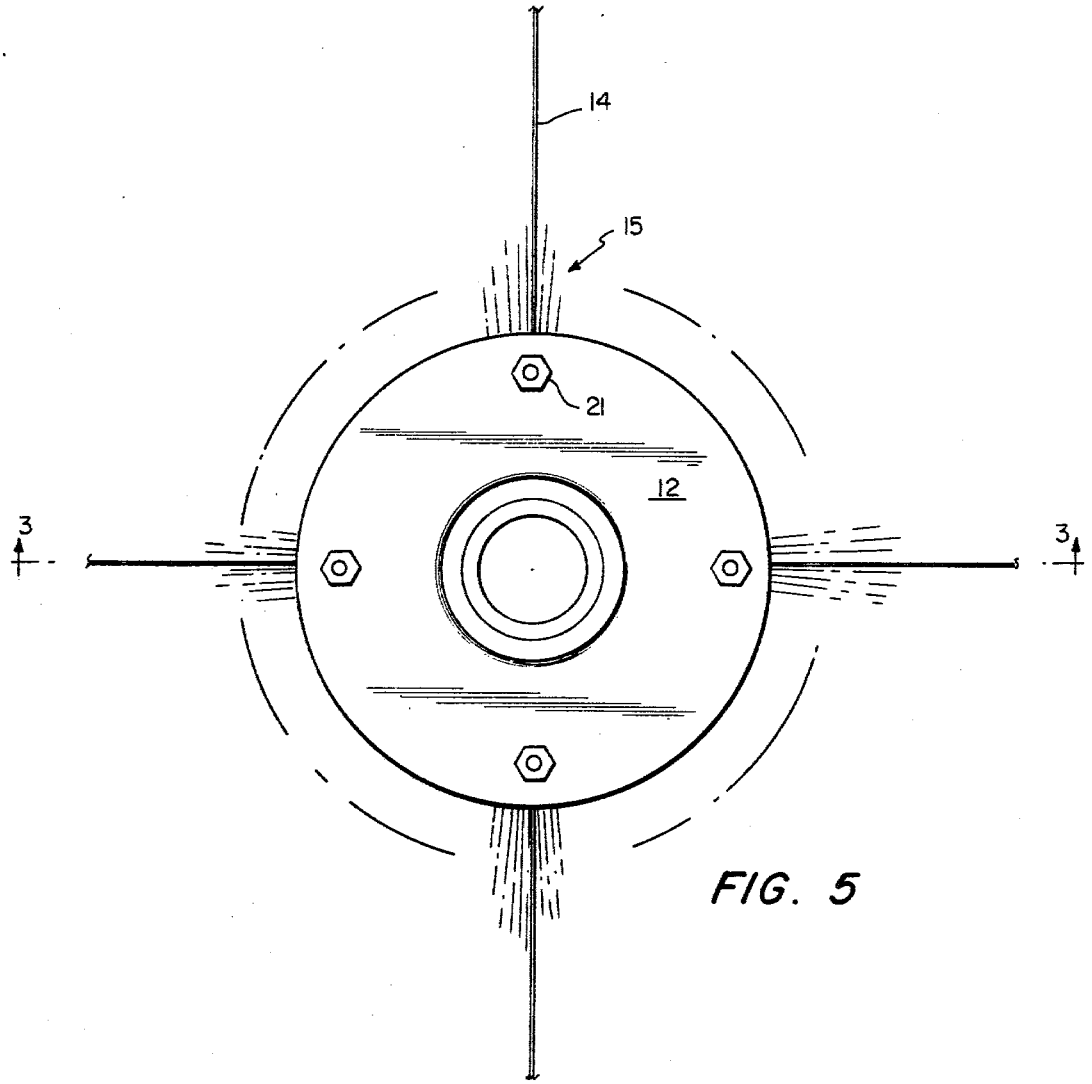
FIG. 5 is an end view of the completed chimney sweeping brush.

Next, the entire assembly consisting of pipe flanges 12 and 17 and nipple 11 and the bundle of pre-formed wire 15 are inverted and a garden hose 22 with coupling 23 is attached by threading it onto the nipple 11. FIG. 5 shows an end view of the completed chimney sweeping brush attached to a garden hose.

In use, the chimney sweeping brush is lowered down through the upper opening of the chimney until the brush reaches a lower limit. During the lowering operation, the pressure of the wire bristles against the side walls of the chimney simply increase the curvature making it easy for the brush to descend into the chimney passageways. When the direction of the motion is reversed and the brush is pulled up, the spring action of the wire bristles forces the bristles against the side walls of the chimney. The result of this action is that the ends of the bristles bite into the side walls dislodging soot and other deposits. The updown action is repeated until the side walls of the chimney are clean.

Various changes and modifications can be made to the embodiment described without departing from the scope of the invention as defined in the appended claims.

It is claimed:

1. A chimney cleaning brush comprising a large number of bristles extending outwardly and upwardly from a center hub, said bristles being symmetrically distributed around the periphery of said center hub, said hub comprising a cylindrical retaining means in which the ends of said bristles are secured, said retaining means including spaced apart planar surfaces of two flanges, said bristles being secured in said retaining means by frictional engagement between said flanges, said bristles comprising preformed lengths of wire, each of said lengths of wire being in the shape of a gentle arc.

2. A brush as defined in claim 1, wherein a tension member is secured to one end of said cylindrical retaining means.

3. A brush as defined in claim 2, wherein said tension member is a garden hose.

* * * * *